United States Patent [19]

Rebel et al.

[11] Patent Number: 4,480,548

[45] Date of Patent: Nov. 6, 1984

[54] DEVICE FOR VARNISHING SYSTEMS TO PREVENT VARNISH DRYING IN OUT OF PAPER SIZE SIDE ZONES OF ROLLERS

[75] Inventors: Herbert Rebel, Rodgau; Manfred Herold, Kahl, both of Fed. Rep. of Germany

[73] Assignee: M.A.N. Roland Druckmaschinen AG, Fed. Rep. of Germany

[21] Appl. No.: 493,735

[22] Filed: May 11, 1983

[30] Foreign Application Priority Data

Jun. 1, 1982 [DE] Fed. Rep. of Germany ..... 3220537

[51] Int. Cl.[3] ..... B41L 41/00

[52] U.S. Cl. ..... 101/426; 101/425; 101/364; 118/46; 118/702; 427/421

[58] Field of Search ..... 101/364, 365, 366, 142, 101/147, 425, 426; 118/702, 704, 46, 203, 300, 302, 313, 321; 427/421

[56] References Cited

U.S. PATENT DOCUMENTS

| | | | |
|---|---|---|---|
| 2,705,455 | 4/1955 | Buttner | 101/425 |
| 2,791,174 | 5/1957 | Koch | 101/425 X |
| 3,462,300 | 8/1969 | Hocutt | 101/425 X |
| 3,508,711 | 4/1970 | Switall | 101/425 |
| 3,552,311 | 1/1971 | Petri | 101/425 X |
| 3,766,853 | 10/1973 | Gallagher et al. | 101/425 X |
| 3,771,446 | 11/1973 | Kaneko et al. | 101/425 |
| 3,896,730 | 7/1975 | Garrett et al. | 101/425 |
| 3,897,726 | 8/1975 | Junghans | 101/425 |
| 3,913,797 | 10/1975 | Brym | 101/425 X |
| 3,931,791 | 1/1976 | Preuss et al. | 101/425 X |
| 3,976,007 | 8/1976 | Junghans et al. | 101/425 |
| 4,270,450 | 6/1981 | Difflipp et al. | 101/425 X |
| 4,270,451 | 6/1981 | Perretta | 101/425 X |
| 4,353,299 | 10/1982 | Murai et al. | 101/425 X |
| 4,369,734 | 1/1983 | Preuss | 101/425 |
| 4,372,244 | 2/1983 | Rebel | 118/46 |

FOREIGN PATENT DOCUMENTS

| | | | |
|---|---|---|---|
| 1264453 | 3/1968 | Fed. Rep. of Germany | 101/425 |
| 2828454 | 1/1979 | Fed. Rep. of Germany | 101/425 |
| 2759 | 7/1982 | Japan | 101/425 |
| 1254439 | 11/1971 | United Kingdom | 101/425 |
| 1406563 | 9/1975 | United Kingdom | 101/425 |
| 1464311 | 2/1977 | United Kingdom | 101/425 |

*Primary Examiner*—E. H. Eickhelt

*Attorney, Agent, or Firm*—Leydig, Voit, Osann, Mayer & Holt, Ltd.

[57] ABSTRACT

A roller cleaning device for a varnishing system in a printing press has liquid-supplying means pivotally arranged above the rollers conveying varnish. The spatial distribution of the liquid-supplying means differs over the length of the rollers. The liquid-supplying means are closer together in two edge zones than in the central zone; the liquid-supplying means in the central zone have nozzles that are spaced apart from one another at a relatively large interval. The liquid-supplying means come into operation at stopping and at the onset and cessation of printing. The liquid-supplying means in the edge zone operate, in accordance with format width, throughout printing.

11 Claims, 4 Drawing Figures

DEVICE FOR VARNISHING SYSTEMS TO PREVENT VARNISH DRYING IN OUT OF PAPER SIZE SIDE ZONES OF ROLLERS

BACKGROUND OF THE INVENTION

The invention relates to a device for roller type varnishing systems in printing presses.

Fine quantity regulation or metering for a dampening system is disclosed by U.S. Pat. No. 3,552,311 wherein metering is effected by inclining a roller, a dampening zone being produced whose width varies in accordance with roller position. It is also known for the dispensing doctor blade of dampening units to be arranged axially. A problem with varnishing systems, more particularly in the case of small formats, is to keep the varnish away from the edge zones, for varnish, unlike dampening agents, hardens. Another problem arising in varnishing is that the varnish dries on the rollers during an interruption in printing.

The conventional remedy in both cases is to wash off dried-on varnish manually before starting printing.

SUMMARY OF THE INVENTION

It is accordingly the object of the invention to prevent the varnish from drying on the rollers and cylinders over the whole width thereof in the event of a stoppage of printing and, during printing, to obviate drying of the varnish in the side zones for format printing.

According to the invention, therefore, a plurality of liquid-supplying means are disposed near the rollers, said means delivering a steplessly variable supply of liquid to the rollers, and being provided with means for selectively bringing the liquid-supplying means into operation at desired zones along the length of the rollers.

If the dampening unit is used as a varnishing unit, the roller side zones can be kept clear of surplus varnish for small-format work by being scraped by the doctor blade. Such scraping does not give 100% removal, and so some particles of varnish remain in the side zones. Such particles are conveyed onwards in the direction of the cylinders. After some time the build-up becomes substantial and remains, hardening on the rollers and cylinders.

The liquid-supplying means are disposed above the roller. Very advantageously, such means can be pivotable in their terminal zones to increase their radius of operation. If so required, the cylinders can be dampened with water.

If format printing is proceeding, the roller edge zones are dampened by the liquid-supplying means for the duration of printing.

The roller end zones are so dampened during printing as to prevent varnish residues from drying on the rollers. If the supply of liquid is fairly substantial, varnish can be returned from the rollers to the varnish tank—i.e., depending upon varnish composition, a balance between evaporation and dampening can be set up on the rollers.

Before the cessation of printing, liquid is supplied to the rolls over their whole width. Very advantageously, this application is made in the case of the varnishing unit a few revolutions before such cessation, so that the dampening is transferred via all the rollers to the cylinders.

This distribution of dampening agent prevents the varnish from drying throughout the interruption in printing.

Spray nozzles can be secured to the ends of the liquid-supplying pipes to give a fine distribution of the liquid. Also, the pipes can be pivotable in two planes in order to cover all the zones of the rollers.

According to a further development, the device can be used to wash the rollers. To this end, the nozzles or spray heads can be actuated individually or jointly and either electrically or pneumatically or electronically. The intervals and the duration of the spraying steps can be varied steplessly.

Water is a very suitable dampening agent since the lacquers mostly used are water-soluble.

BRIEF DESCRIPTION OF THE DRAWINGS

Other advantages and important features of the invention will be apparent from the following description taken together with the embodiments diagrammatically illustrated in the drawings wherein.

Figures 1A, 1B, 2:
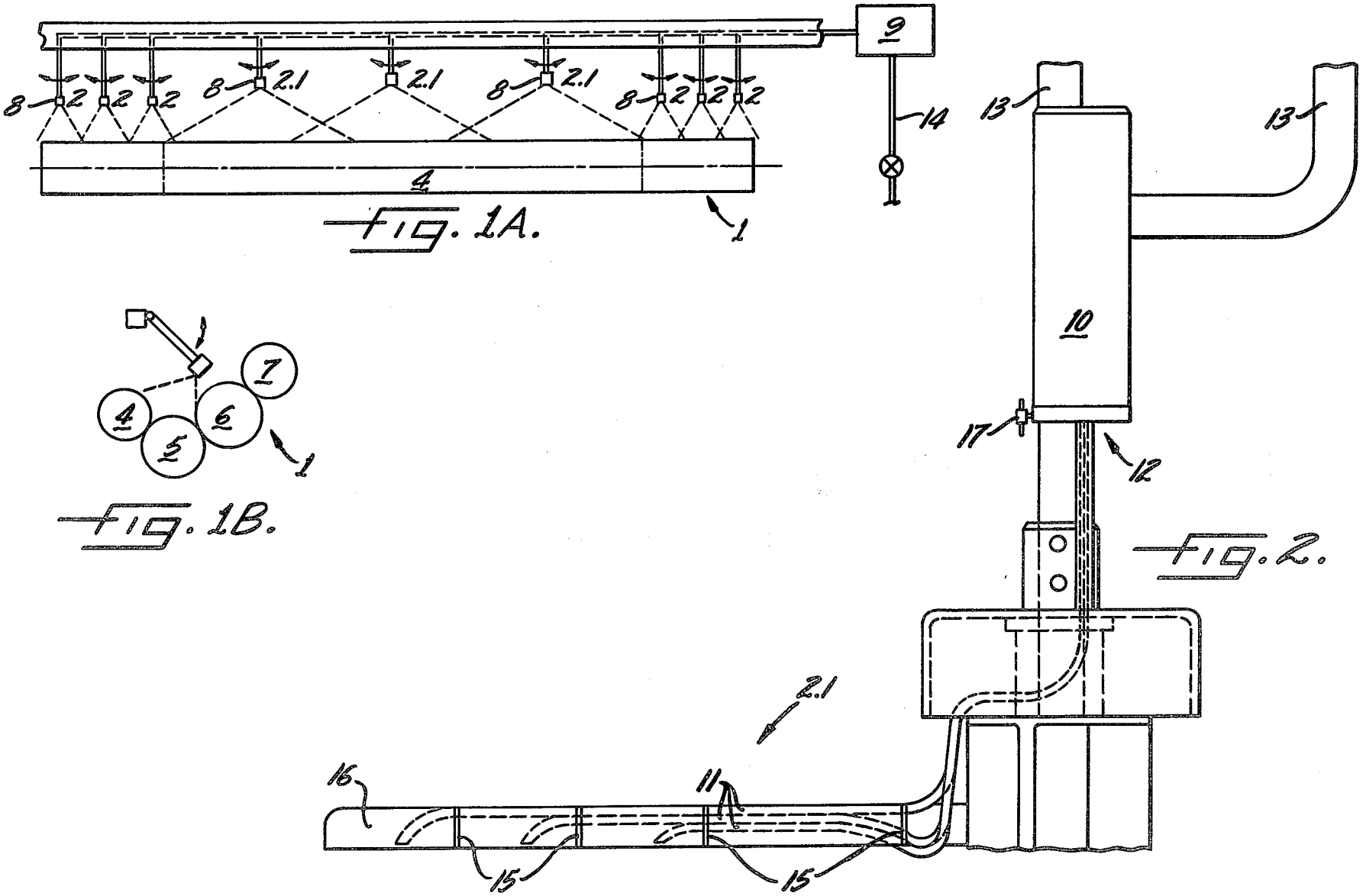
FIGS. 1A and 1B show respective front and side views of a liquid-supplying means distributed over the whole width of the rollers, together with a control facility.
FIG. 2 shows a particular arrangement of the liquid-supplying means in the roller side zone, with pressureless reservoirs.

It is not intended to limit the invention to the specific embodiment shown in the drawings, but, on the contrary, the intention is to cover all modifications, equivalents, and alternatives falling within the spirit and scope of the invention as defined by the appended claims.

DESCRIPTION OF THE PREFERRED EMBODIMENT

Turning now to the drawings, FIGS. 1A and 1B show a dampening unit used as a varnishing unit 1 in a printing press. Liquid-supplying means 2, 2.1 are disposed above the unit 1. The means 2, 2.1 are pivoted in two planes so that rollers 4–7 of the unit 1 can be sprayed in all their zones as required.

The means 2, 2.1 are so disposed along the length of the rollers 4–7 that means 2 are disposed in closely adjacent relationship to one another in the two side zones of the rollers 4–7. The number of means 2 corresponds approximately to the minimum size for format printing on one page.

The liquid-supplying means 2 operate for as long as printing is proceeding. Liquid delivery is adjusted to suit requirements from drops up to a light spray mist. To this end nozzles 8 are fitted to the end of the means 2, 2.1. The main factor determining whether to fit the nozzles 8 is the size of coverage for format printing and the nature of the particular varnish used.

The liquid-supplying means 2.1 are pivotally disposed between the means 2, and further apart from one another than are the latter, in the central zone of the rollers 4–7. A control facility 9 so controls the means 2.1 that they dampen the rollers 4–7 before the starting of printing and shortly before stoppage and wash the rollers 4–7 after printing. Dampening the rollers 4–7 before printing dissolves the particles of varnish still present on the rollers 4–7 after washing, so that the layer of varnish disappears after a few sheets have passed through.

Dampening the rollers 4–7 by the liquid-supplying means 2.1 shortly before the stoppage ensures that the varnish cannot dry on the rollers 4–7 over their whole length while the press is inoperative. These steps obviate the conventional work of cleaning the rollers 4–7 and the elaborate job of cleaning the cylinders and cleaning of the inking mechanism, since the particles of varnish must not be conveyed beyond the rollers 4–7 and the cylinders.

The control facility 9 is electric or pneumatic or electronic. A supply line 14 is provided in the facility 9 for distribution to the various means 2, 2.1.

FIG. 2 is a detail view showing a side zone above the rollers 4–7 with liquid-supplying means 2.1. In this particular construction pipes 11 are so laid on a common member 16 that the liquid issues in the form of drops without substantial pressure; the height at which the ends of the pipes 11 are disposed above the rollers 4–7 is such that the drops do not splash on the roller surfaces. The common member 16 is preferably a guard pivotally mounted to side retaining members 13 of the press. For accurate location the pipes 11 are secured by means of pipe-retaining members 15 to the guard 16 of the printing press. The reservoir 10 is attached by fasteners 18 to the side retaining members 13 of the press. A distributor 12 having valves 17 is disposed below the reservoir 10. Alternatively, the pipes 11 can be secured to cross-members above the rollers 4–7.

Figure 3:
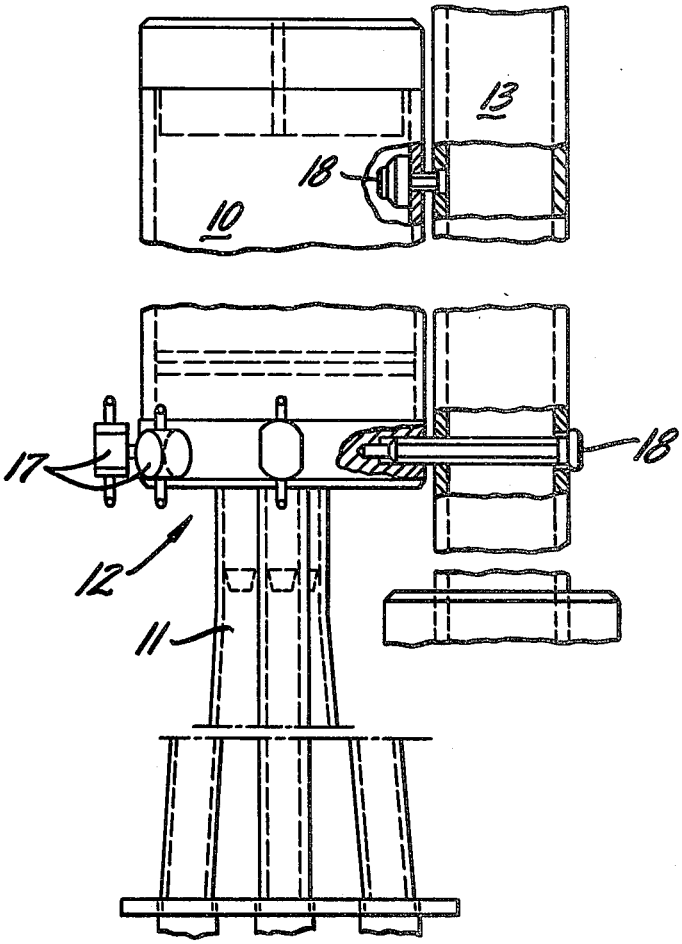
FIG. 3 is a detailed view of the reservoir with shut-off valves and a distributor below the reservoir.

FIG. 3 shows the reservoir 10 with means 18 for securing it to the side retaining members 13. The distributor 12 has branches, one branch being provided for each pipe 11 or liquid-supplying means 2, 2.1 for dampening the rolls 4–7. The pipes 11 are shut off by means of the valves 17 or the liquid is quantity-regulated by means of the valves 17. One three-way valve can be used in the example illustrated instead of the three valves 17. As mentioned in the description referring to FIG. 1, in the non-pressureless construction with the control facility 9 the various valves are controlled centrally.

We claim:

1. During the operation of a printing press having a varnishing system with a plurality of rollers for conveying varnish to paper being printed, a method of preventing the drying and accumulation of varnish in the side zones of the rollers which are out of the paper size comprising the step of continuously and selectively applying during printing dampening agent capable of dissolving the varnish to the side zones of the rollers which are out of the paper size.

2. The method as claimed in claim 1 wherein the step of applying dampening agent applies drops of dampening agent to the rollers.

3. The method as claimed in claim 1 wherein the step of applying the dampening agent includes the step of adjusting a plurality of valves regulating the flow of said dampening agent to a plurality of discrete zones along the length of the rollers.

4. The method as claimed in claim 3 wherein the step of adjusting the plurality of valves includes opening and adjusting those of said valves regulating the flow of said dampening agent to the side zones of the rollers out of the paper size so that the amount of dampening agent applied approximately balances the dampening agent lost by evaporation.

5. In a printing press having a varnishing system with a plurality of rollers conveying varnish to paper being printed, a device for preventing the drying and accumulation of varnish in the side zones of the rollers which are out of the paper size comprising a plurality of liquid-supplying means disposed near the rollers, said liquid-supplying means delivering a variable supply of liquid varnish solvent to the rollers, and means for selectively bringing the liquid-supplying means into operation at discrete zones along the rollers during printing, to thereby prevent the varnish from accumulating and drying in the side zones.

6. The device as claimed in claim 5, wherein a plurality of the liquid-supplying means are provided for delivering liquid to each of the zones at the end portions of the rollers, and the delivery of liquid is continuous.

7. The device as claimed in claim 5, further comprising a central unit adjusting the delivery of liquid to the liquid-supplying means.

8. The device as claimed in claim 5, further comprising pipes delivering liquid to the liquid-supply means from at least one reservoir, the pipes being fed from the bottom of the reservoir so that the liquid is discharged from the liquid-supplying means without substantial pressure.

9. The device as claimed in claim 8, wherein the reservoir is secured to side retaining members of the printing press.

10. The device as claimed in claim 9, wherein the pipes are laid from the reservoir to the liquid-supplying means along a common member in such a fashion that metering of the liquid is automatic.

11. The device as claimed in claim 10, wherein the common member is pivotally mounted to the side retaining members of the printing press.

* * * * *